US011939894B2

(12) United States Patent
Matsue et al.

(10) Patent No.: US 11,939,894 B2
(45) Date of Patent: Mar. 26, 2024

(54) OUTBOARD MOTOR AND MARINE VESSEL THAT ARE CAPABLE OF FURTHER IMPROVING MAINTAINABILITY OF OUTBOARD MOTOR

(71) Applicant: YAMAHA HATSUDOKI KABUSHIKI KAISHA, Iwata (JP)

(72) Inventors: Hiroto Matsue, Shizuoka (JP); Shinya Maekawa, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 17/955,787

(22) Filed: Sep. 29, 2022

(65) Prior Publication Data

US 2023/0115262 A1 Apr. 13, 2023

(30) Foreign Application Priority Data

Oct. 12, 2021 (JP) ..... 2021-167604

(51) Int. Cl.

| | |
|---|---|
| ***F01M 11/03*** | (2006.01) |
| ***B63H 20/32*** | (2006.01) |
| ***F01M 11/02*** | (2006.01) |
| ***F01M 11/12*** | (2006.01) |

(52) U.S. Cl.

CPC ..... *F01M 11/03* (2013.01); *B63H 20/32* (2013.01); *F01M 11/02* (2013.01); *F01M 11/12* (2013.01)

(58) Field of Classification Search

CPC ..... F01M 11/03; F01M 11/02; F01M 11/12; B63H 20/32; B63H 20/002; B63H 20/12

See application file for complete search history.

(56) References Cited

U.S. PATENT DOCUMENTS

| | | | | |
|---|---|---|---|---|
| 10,065,722 | B1 * | 9/2018 | Jaszewski | F16H 57/0441 |
| 10,723,427 | B1 * | 7/2020 | Egleston | B01D 29/15 |
| 11,572,145 | B1 * | 2/2023 | Andrasko | B63H 20/12 |
| 2002/0111090 | A1 * | 8/2002 | Tsubouchi | F01M 11/12 440/88 L |

FOREIGN PATENT DOCUMENTS

| | | | | |
|---|---|---|---|---|
| CA | 2695058 | C * | 6/2012 | F01M 11/02 |
| JP | 09-41930 | A | 2/1997 | |
| JP | 2002-242642 | A | 8/2002 | |
| JP | 3511848 | B2 | 3/2004 | |
| JP | 7147349 | B2 * | 10/2022 | B63H 20/14 |

* cited by examiner

*Primary Examiner* — Syed O Hasan

(74) *Attorney, Agent, or Firm* — Keating & Bennett, LLP

(57) ABSTRACT

An outboard motor with improved maintainability and attachable to a hull of a marine vessel includes an internal combustion engine and a cowl to cover the internal combustion engine. The internal combustion engine includes an oil filler to feed oil thereto and an oil filter to filter the oil. In a case that a direction perpendicular or substantially perpendicular to a bottom of the hull is a vertical direction, the cowl is separable into a top cowl to cover an upper portion of the internal combustion engine and a side cowl to cover a side portion of the internal combustion engine. At least a portion of the oil filler or at least a portion of the oil filter is located above a separating line which is a boundary between the top cowl and the side cowl.

15 Claims, 10 Drawing Sheets

OUTBOARD MOTOR AND MARINE VESSEL THAT ARE CAPABLE OF FURTHER IMPROVING MAINTAINABILITY OF OUTBOARD MOTOR

CROSS REFERENCE TO RELATED APPLICATIONS

This application claims the benefit of priority to Japanese Patent Application No. 2021-167604, filed on Oct. 12, 2021. The entire contents of this application are hereby incorporated herein by reference.

BACKGROUND OF THE INVENTION

1. Field of the Invention

The present invention relates to an outboard motor and a marine vessel.

2. Description of the Related Art

In an outboard motor equipped with an internal combustion engine, there is a demand for performing a light maintenance such as an oil change without detaching the outboard motor from a hull of a marine vessel. During the oil change, a plurality of operations such as replacement of an oil filter, feeding new oil from an oil filler, and confirming the amount of fed oil by an oil level gauge (a dip stick) are performed.

Therefore, in order to easily perform the plurality of operations that accompany the oil change, it is known that in the outboard motor, the oil filter, an oil feeding port of the oil filler, and a grip of the oil level gauge are located so as to be adjacent to each other (see, for example, U.S. Pat. No. 10,723,427).

In the outboard motor, the entire surface of the internal combustion engine is covered with a cowl so that the internal combustion engine is not directly exposed to water. Since it takes time and labor to detach the entire cowl every time the oil change is performed, a maintenance lid is provided on the cowl or the cowl is configured to be dividable or separable. In addition, when performing the oil change, a user or a mechanic opens the maintenance lid or detaches a part of the cowl which is separable, and then accesses the oil filter, the oil filler, and the grip of the oil level gauge.

However, the maintenance lid or the part of the cowl which is detachable is located above the internal combustion engine. On the other hand, since the oil filter, the oil filler, and the grip of the oil level gauge are located on the side of the internal combustion engine, even in the case that the user or the mechanic opens the maintenance lid or detaches a portion of the cowl which is separable, the oil filter, the oil filler, and the grip of the oil level gauge remain covered by the remaining portion of the cowl.

Therefore, the user or the mechanic is not able to easily access the oil filter, the oil feeding port of the oil filler, and the grip of the oil level gauge, and there is room for improvement from the viewpoint of improving maintainability.

SUMMARY OF THE INVENTION

Preferred embodiments of the present invention provide outboard motors and marine vessels that are each able to improve the maintainability of the outboard motors.

According to a preferred embodiment of the present invention, an outboard motor attachable to a hull of a marine vessel includes an internal combustion engine and a cowl to cover the internal combustion engine. The internal combustion engine includes an oil filler to feed oil thereto and an oil filter to filter the oil. In a case that a direction perpendicular or substantially perpendicular to a bottom of the hull is a vertical direction, the cowl is separable into a top cowl to cover an upper portion of the internal combustion engine and a side cowl to cover a side portion of the internal combustion engine. At least a portion of the oil filler or at least a portion of the oil filter is located above a separating line which is a boundary between the top cowl and the side cowl.

According to another preferred embodiment of the present invention, an outboard motor attachable to a hull of a marine vessel includes an internal combustion engine and a cowl to cover the internal combustion engine. The internal combustion engine includes an oil filler to feed oil thereto and an oil filter to filter the oil. A portion of the cowl defines a lid body which is detachable from the cowl. In a case that a direction perpendicular or substantially perpendicular to a bottom of the hull is defined as a vertical direction, at least a portion of the oil filler or at least a portion of the oil filter is located above a separating line which is a boundary between the lid body and a remaining portion of the cowl.

According to another preferred embodiment of the present invention, a marine vessel includes the outboard motor.

According to the preferred embodiments of the present invention described above, since at least the portion of the oil filler or at least the portion of the oil filter is located above the separating line, which is the boundary between the top cowl and the side cowl, when the top cowl is detached, at least the portion of the oil filler or at least the portion of the oil filter is no longer covered by the side cowl. As a result, the user is able to easily access the oil filler and the oil filter, and thus it is possible to further improve the maintainability of the outboard motor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
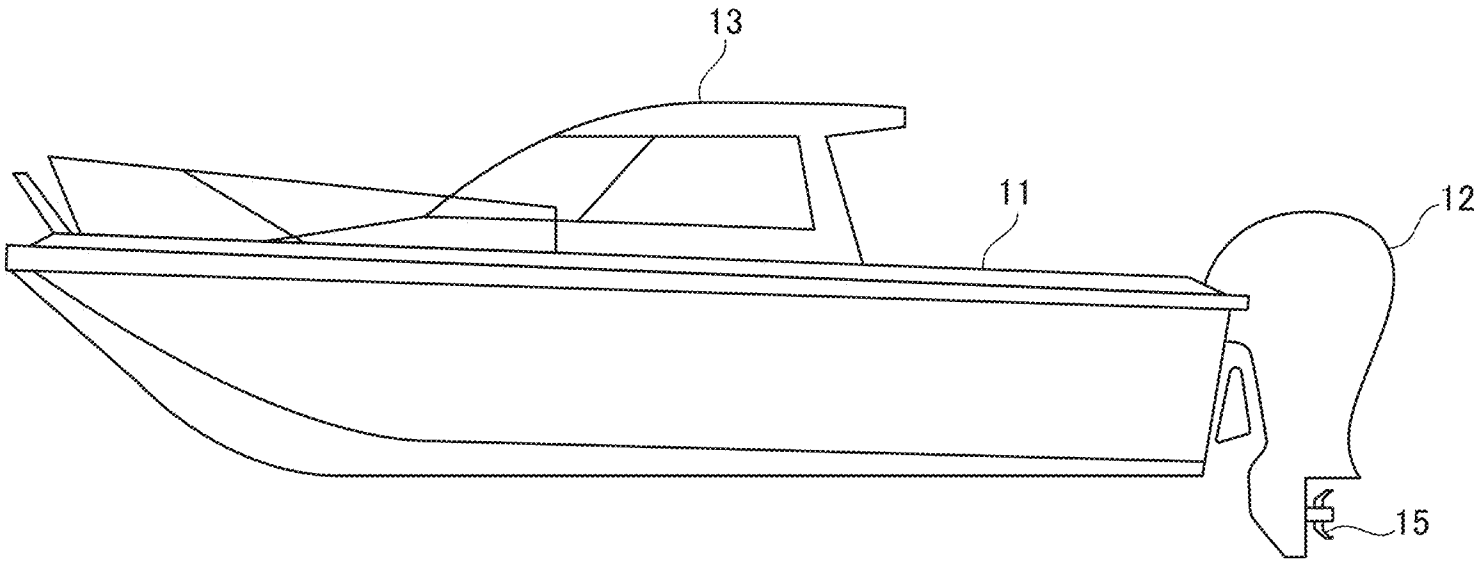
FIG. 1 is a side view of a marine vessel to which an outboard motor according to a preferred embodiment of the present invention is applied.
Figure 2:
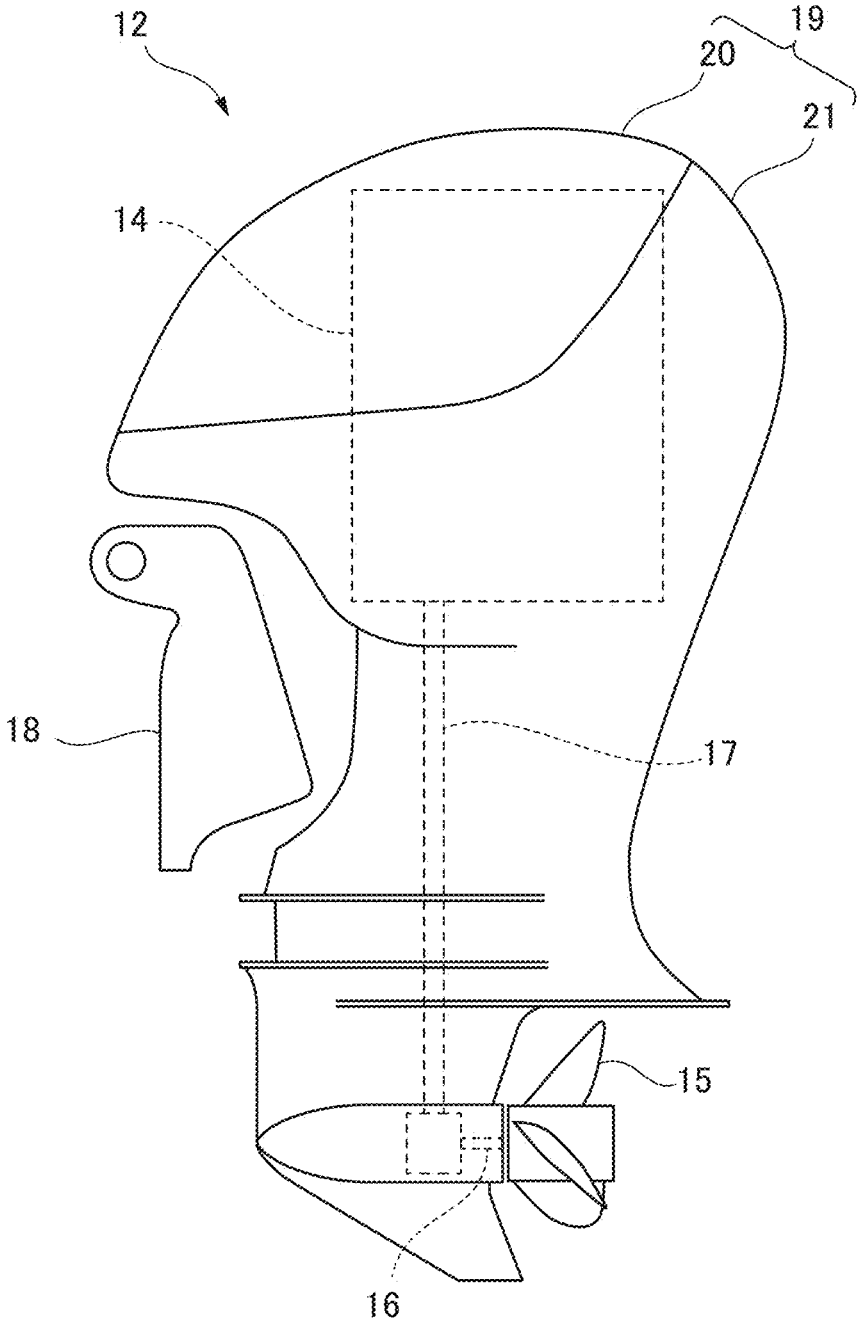
FIG. 2 is a side view that schematically shows a configuration of the outboard motor according to a preferred embodiment of the present invention.

FIG. 1 is a side view of a marine vessel to which an outboard motor according to a preferred embodiment of the present invention is applied. FIG. 2 is a side view that schematically shows a configuration of the outboard motor according to a preferred embodiment of the present invention.

As shown in FIG. 1, a marine vessel 10 may be, for example, a planing boat, and includes a hull 11 and at least one, for example, two outboard motors 12 functioning as propulsion devices attached to the stern of the hull 11. A cabin 13 that functions as a cockpit seat is provided on the hull 11. The outboard motor 12 includes an engine 14 that is an internal combustion engine, a propeller 15, a propeller shaft 16 to rotate the propeller 15, and a drive shaft 17 to transmit a drive force of the engine 14 to the propeller shaft 16. The outboard motor 12 applies a thrust to the marine vessel 10 with the propeller 15 rotated by the drive force of the engine 14.

The outboard motor 12 is provided with a steering mechanism (not shown), and the steering mechanism adjusts an acting direction of the thrust generated by the outboard motor 12 by swinging the outboard motor 12 substantially horizontally with respect to the hull 11. In addition, as shown in FIG. 2, the outboard motor 12 includes a suspension mechanism 18 that attaches the outboard motor 12 to the stern of the hull 11. The suspension mechanism 18 functions as a lifting mechanism for the outboard motor 12, and tilts up the outboard motor 12 when the marine vessel 10 is stored.

Although a large amount of splashing is applied to the outboard motor 12, as shown in FIG. 2, the outboard motor 12 includes a cowl 19 that covers the entire surface of the engine 14 so that each element of the engine 14 is not corroded by salt water or the like. In addition to the engine 14, the cowl 19 also covers the propeller shaft 16 and the drive shaft 17.

As is well known, it is necessary to perform a light maintenance on a regular basis with respect to the engine 14, and in the light maintenance, for example, the oil of the engine 14 is changed (i.e., an oil change of the engine 14 is performed). When performing the oil change of the engine 14, a plurality of operations such as replacement of an oil filter attached to the engine 14, feeding new oil from an oil filler, and confirming the amount of fed oil by an oil level gauge are performed. However, when performing the operations that accompany the oil change of the engine 14, since a user or a mechanic accesses the oil filter, the oil filler, and the oil level gauge, detaching all of the cowl 19 from the outboard motor 12 is a heavy burden. Therefore, in the outboard motor 12, the cowl 19 is separable. Specifically, the cowl 19 is separable into a top cowl 20 that covers an upper portion of the engine 14 and a side cowl 21 that covers a side portion of the engine 14. The top cowl 20 is detachable from the side cowl 21, or the top cowl 20 is able to be flipped up with respect to the side cowl 21 by a hinge (not shown) provided at a boundary between the top cowl 20 and the side cowl 21.

In a preferred embodiment of the present invention, a direction perpendicular or substantially perpendicular to a bottom of the hull 11 of the marine vessel 10 is defined as a vertical direction. This vertical direction is, for example, a direction perpendicular or substantially perpendicular to flat land when the marine vessel 10 is on land, and a direction perpendicular or substantially perpendicular to a water surface when the marine vessel 10 is stopped and floating on the water surface.

Figure 3:
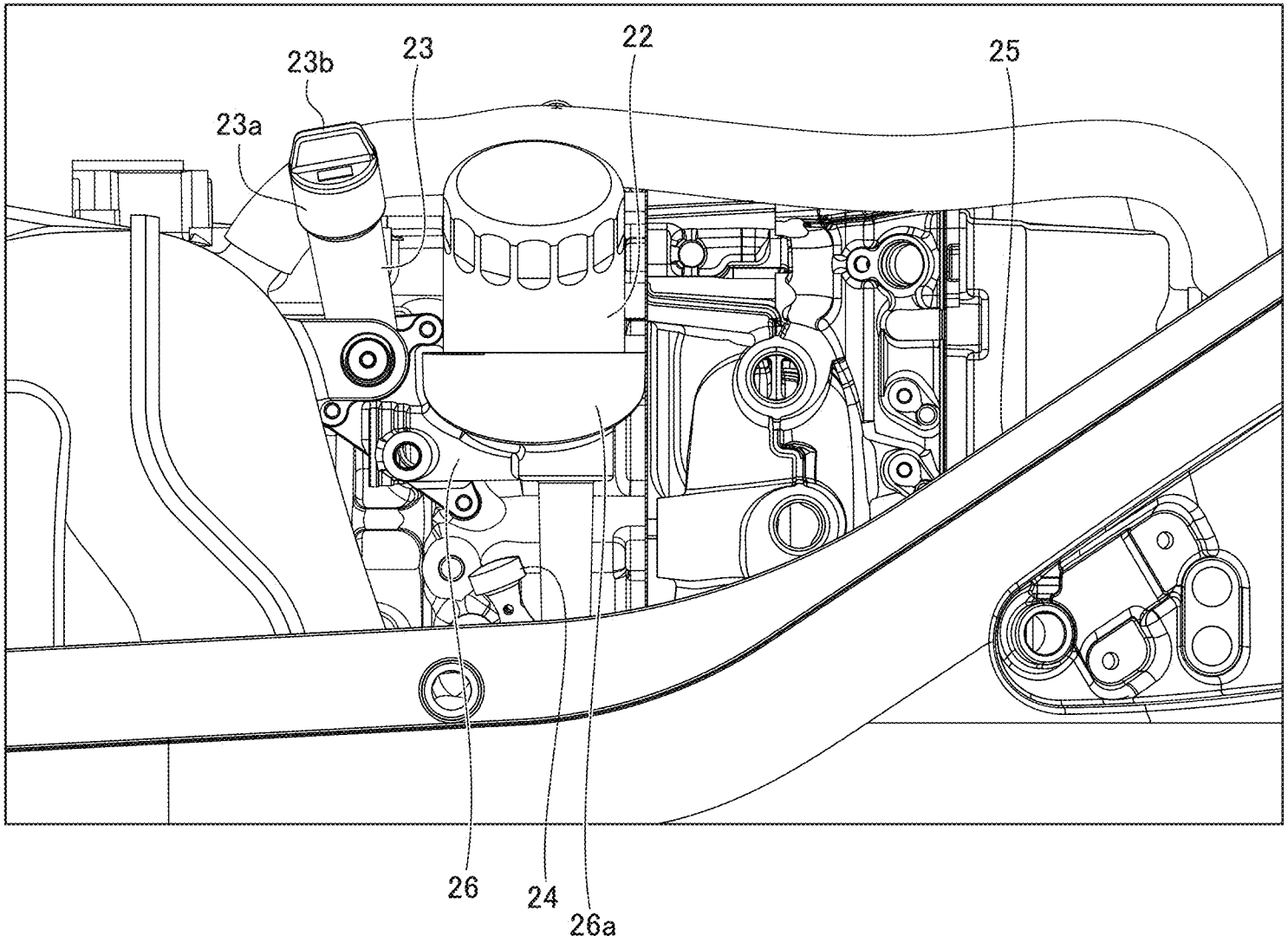
FIG. 3 is a partially enlarged side view that shows the periphery of an engine in a case that a top cowl is detached from a side cowl.
Figure 4:
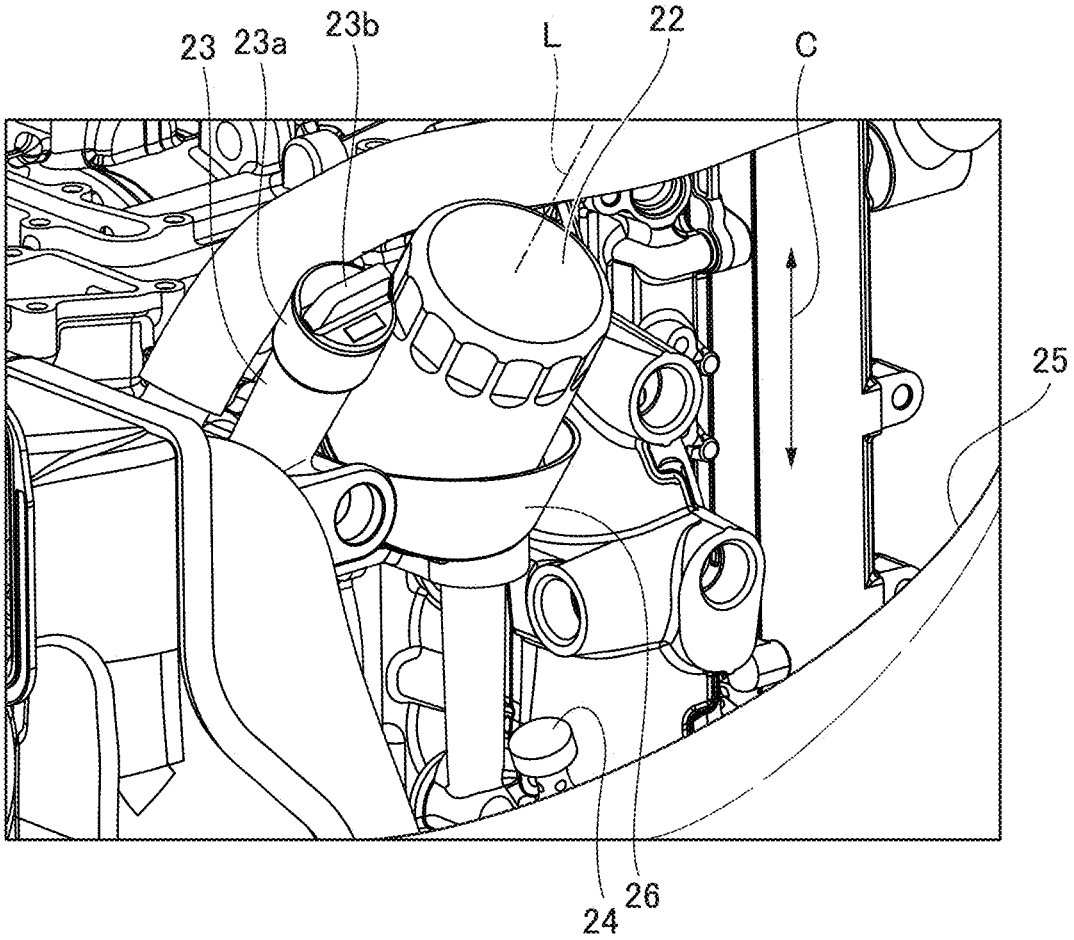
FIG. 4 is a partially enlarged perspective view that shows the periphery of the engine in the case that the top cowl is detached from the side cowl.

FIG. 3 is a partially enlarged side view that shows the periphery of the engine 14 in a case that the top cowl 20 is detached from the side cowl 21. FIG. 4 is a partially enlarged perspective view that shows the periphery of the engine 14 in the case that the top cowl 20 is detached from the side cowl 21.

As shown in FIGS. 3 and 4, an oil filter 22 that filters oil circulating within the inside of the engine 14, a tubular oil filler 23 that feeds the oil, and a grip 24 of the oil level gauge are provided on a side surface of the upper portion of the engine 14. The oil filter 22, the oil filler 23, and the grip 24 of the oil level gauge are located adjacent or close to each other so that each operation that accompanies the oil change performed by the user is efficiently performed.

Further, as shown in FIGS. 3 and 4, the entire oil filter 22 is located above a separating line 25 which is the boundary between the top cowl 20 and the side cowl 21. Furthermore, an oil feeding port 23*a* and a lid 23*b* of the oil filler 23 are also located above the separating line 25. Moreover, the grip 24 of the oil level gauge is also located above the separating line 25.

The oil filter 22 is attached to a cylinder block of the engine 14 via an oil connector 26. The oil filter 22 has a substantially columnar shape, and is able to be attached to and detached from the oil connector 26 by rotating the oil filter 22 around a rotation axis L (see FIG. 4) which is a central axis of the oil filter 22. The rotation axis L is tilted with respect to an axial direction C (see FIG. 4) of a crank shaft (not shown) of the engine 14. Specifically, the rotation axis L of the oil filter 22 is tilted with respect to the axial direction C of the crank shaft so that an upper end portion of the oil filter 22 is farther from the engine 14 than a lower end portion of the oil filter 22 (i.e., the upper end portion of the oil filter 22 is located farther outside the engine 14 than the lower end portion of the oil filter 22). As a result, the user who holds an upper end of the oil filter 22 directly or by a tool and rotates the oil filter 22 is able to easily hold the upper end of the oil filter 22, and thus it is possible to improve the workability of replacing the oil filter 22. It should be noted that the axial direction C of the crank shaft shown in FIG. 4 does not indicate a position of the crank shaft, but indicates an axial direction parallel to the crank shaft.

The oil filler 23 has a cylindrical shape. A central axis of the oil filler 23 is substantially parallel to the rotation axis L of the oil filter 22, and an angle formed by the central axis of the oil filler 23 and the rotation axis L of the oil filter 22 is, for example, about 15° or less. As a result, the user is able to access the oil filter 22 and the oil filler 23 from substantially the same angle, and thus it is possible to improve the workability.

As with the oil filter 22, the central axis of the oil filler 23 is also tilted with respect to the axial direction C of the crank shaft so that an upper portion of the oil filler 23 is farther from the engine 14 than a lower portion of the oil filler 23. As a result, the user who opens the lid 23*b* of the oil feeding port 23*a* located at an upper end of the oil filler 23 and feeds the oil to the engine 14 is able to easily insert an oil supply port of an oil jug (not shown) into the oil feeding port 23*a*, and thus it is possible to improve the workability of feeding the oil to the engine 14.

Figure 5:
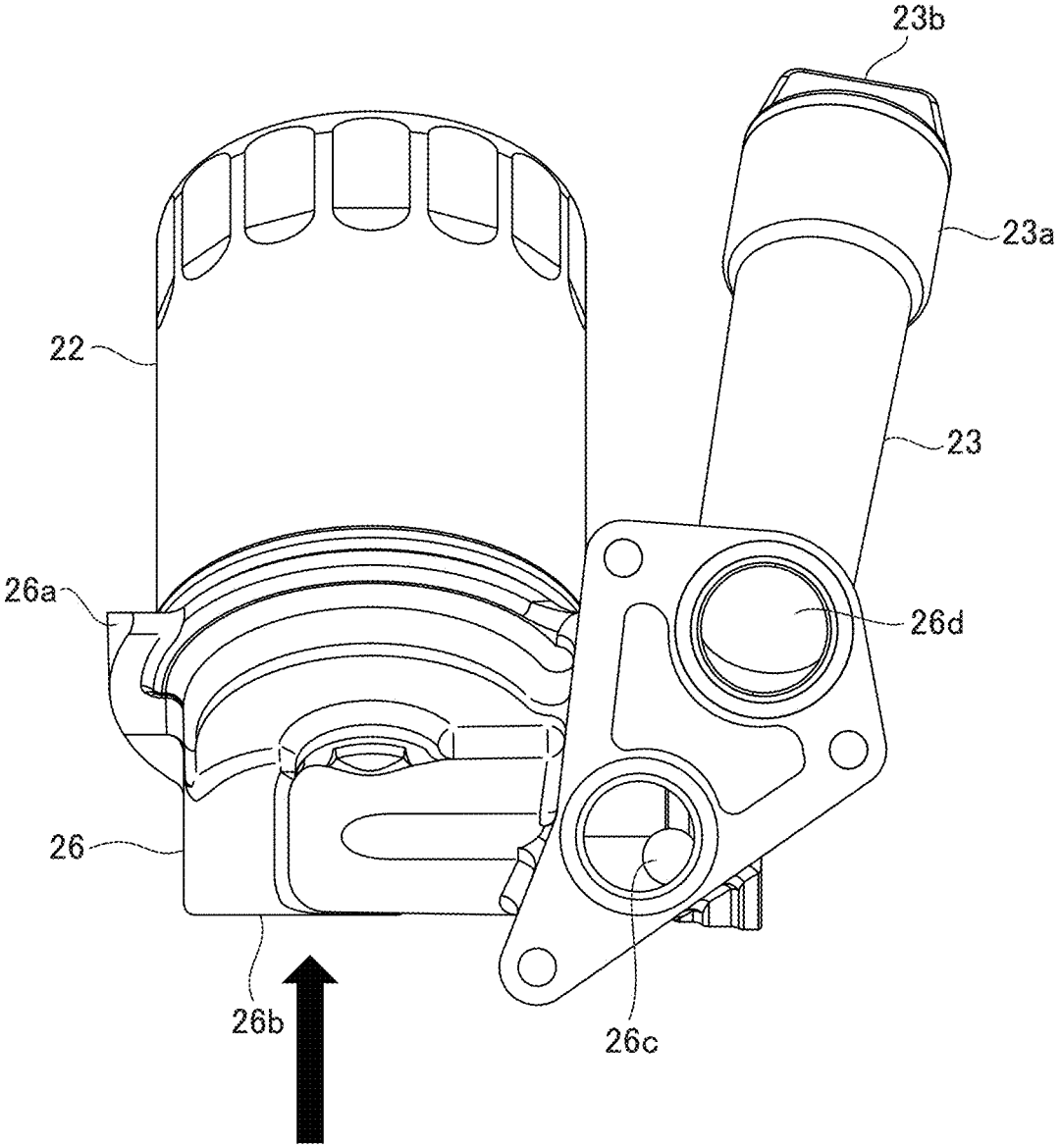
FIG. 5 is a view when an oil connector is viewed from the side of a crank shaft of the engine.

FIG. 5 is a view when the oil connector 26 is viewed from the side of the crank shaft of the engine 14. In FIG. 5, the oil filter 22 and the oil filler 23 are attached to the oil connector 26.

The oil filter 22 is attached to the oil connector 26 via the lower end portion having an opening (not shown), and the oil connector 26 is provided with a wall-shaped oil receiver 26*a* so as to surround the lower end portion of the attached oil filter 22. When the oil filter 22 is detached from the oil connector 26, sometimes the oil remaining in the inside of the oil filter 22 will drip from the opening to an oil filter attaching portion (not shown) of the oil connector 26. However, since the oil receiver 26*a* prevents the dripping oil from overflowing from the oil filter attaching portion, it is possible to prevent the oil from falling into a gap between the engine 14 and the side cowl 21. The oil dripping on the oil filter attaching portion flows into an oil introduction path 26*b* and a return flow path 26*c*, which will be described below.

In addition, the oil connector 26 includes the oil introduction path 26*b* that allows the oil to flow toward the oil filter 22 (an arrow in FIG. 5 indicates the flow of the oil), the return flow path 26*c* that returns the oil filtered by the oil filter 22 to the cylinder block, and an oil supply path 26*d* that supplies the oil, which is fed from the oil feeding port 23*a* of the oil filler 23, to a crank chamber (not shown) of the engine 14.

Although the oil pressurized by an oil pump (not shown) flows through the oil introduction path 26*b* and the return flow path 26*c*, the oil introduction path 26*b* and the return flow path 26*c* are independent of the oil supply path 26*d*. As a result, it is possible to prevent the pressurized oil from flowing into the oil supply path 26*d* and eventually blown out from the oil feeding port 23*a* of the oil filler 23.

According to a preferred embodiment of the present invention, the entire oil filter 22, the oil feeding port 23*a* and the lid 23*b* of the oil filler 23, and the grip 24 of the oil level gauge are located above the separating line 25 which is the boundary between the top cowl 20 and the side cowl 21. As a result, when the top cowl 20 is detached from the side cowl 21, the user is able to easily access the oil filter 22, the oil feeding port 23*a* and the lid 23*b* of the oil filler 23, and the grip 24 of the oil level gauge, and thus it is possible to perform various kinds of operations that accompany the oil change as a series of operations, and it is possible to further improve the maintainability of the outboard motor 12.

In addition, in a preferred embodiment of the present invention, since the user accesses the oil filter 22, the oil feeding port 23*a* and the lid 23*b* of the oil filler 23, and the grip 24 of the oil level gauge, it is not necessary to detach the entire cowl 19, and only the top cowl 20 needs to be detached. From this point as well, it is possible to further improve the maintainability of the outboard motor 12.

Although preferred embodiments of the present invention have been described above, the present invention is not limited to the above-described preferred embodiments, and various modifications and changes can be made within the scope and the gist thereof.

Figure 6:
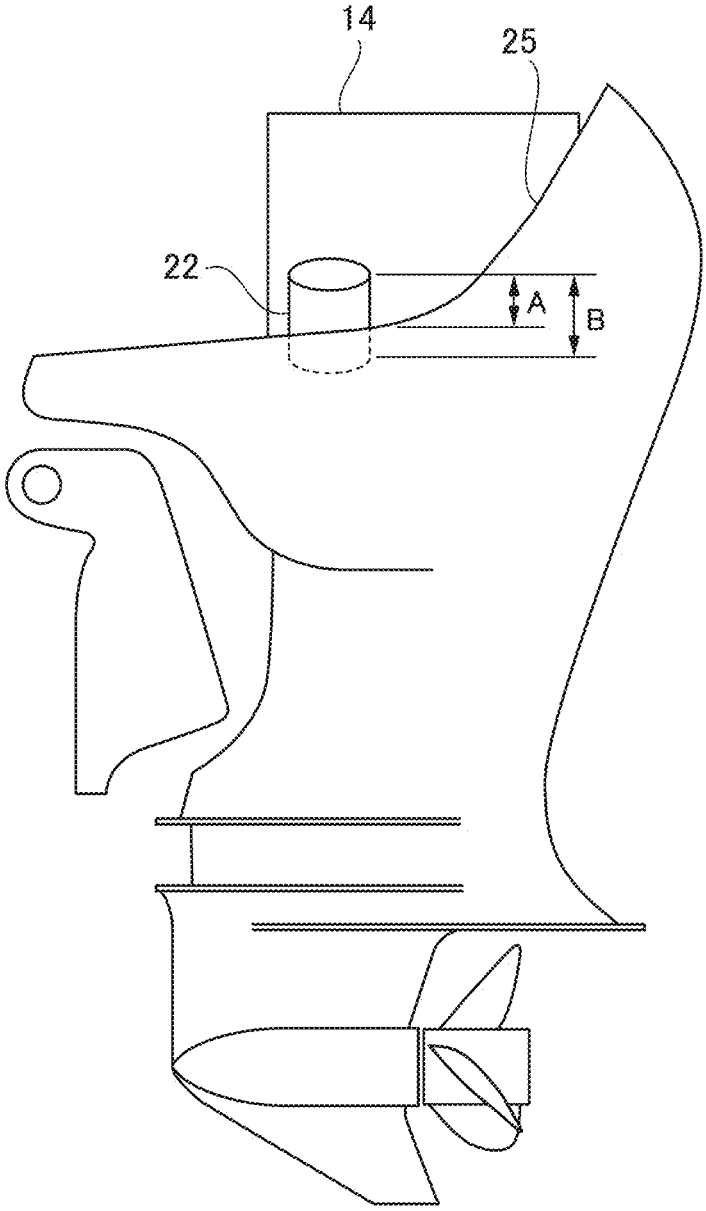
FIG. 6 is a side view that schematically shows a configuration of a first modification example of an outboard motor according to a preferred embodiment of the present invention.

For example, in a preferred embodiment of the present invention described above, although the entire oil filter 22 is located above the separating line 25, the present invention is not limited to this and at least an upper half of the oil filter 22 may be located above the separating line 25. Specifically, as shown in FIG. 6, in a case that it is assumed that a length of a portion of the oil filter 22 existing above the separating line 25 is A and the total length of the oil filter 22 is B, only the following equation (1) needs to be satisfied.

$$2 \times A \geq B \quad (1)$$

In this case, when the top cowl 20 is detached, the user is able to access the upper end of the oil filter 22 and easily replace the oil filter 22. Further, in this case, it is possible to lower a position of the oil filter 22, and for example, the upper end of the oil filter 22 may be located below an upper end of the engine 14. As a result, it becomes easier to secure a space above the engine 14, so that it is possible to facilitate a layout of auxiliary equipment of the engine 14.

Figure 7:
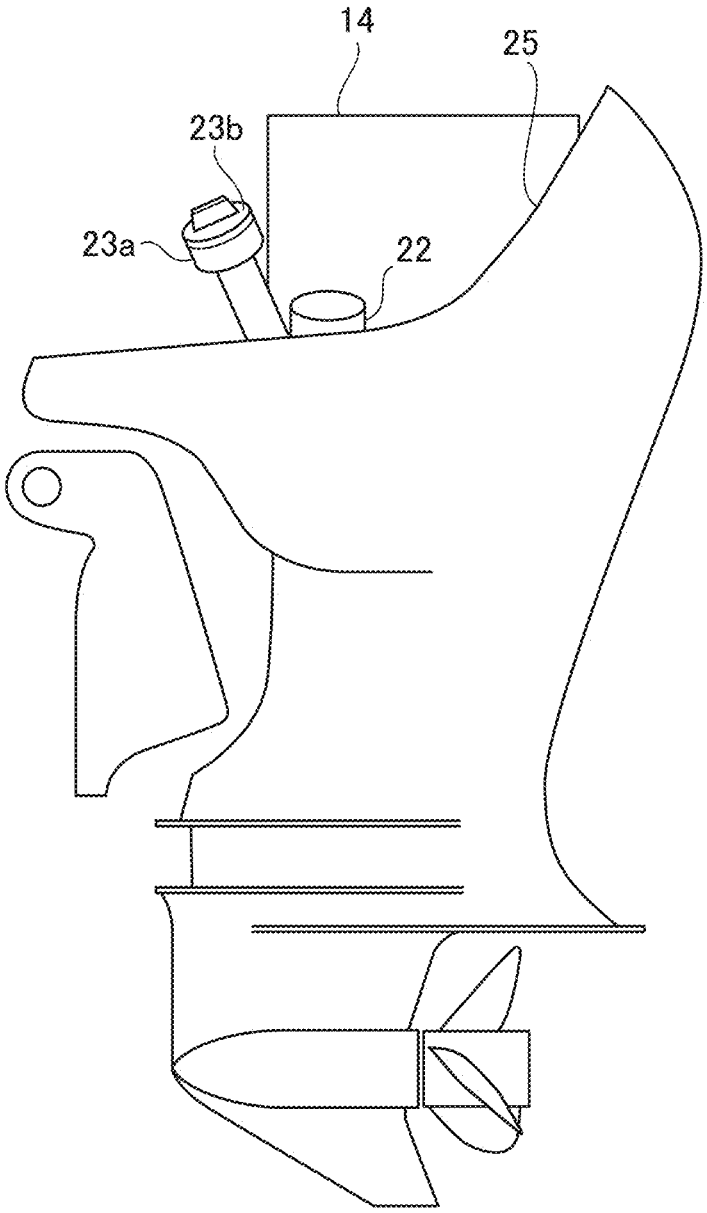
FIG. 7 is a side view that schematically shows a configuration of a second modification example of an outboard motor according to a preferred embodiment of the present invention.

Furthermore, as shown in FIG. 7, even in a case that the upper half of the oil filter 22 is not located above the separating line 25, the oil feeding port 23*a* and the lid 23*b* of the oil filler 23 may be located above the separating line 25. As a result, since the user is able to easily access the oil feeding port 23*a* and the lid 23*b* of the oil filler 23, it is possible to at least improve the workability of the feeding the oil.

Figure 8:
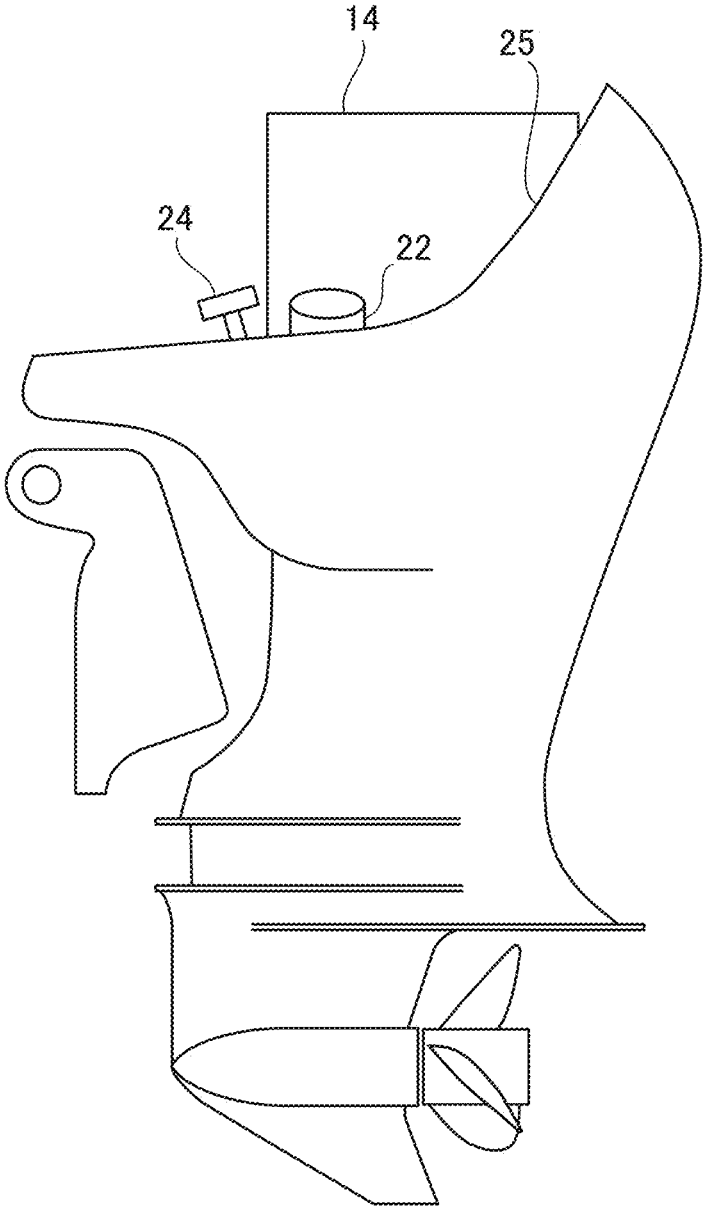
FIG. 8 is a side view that schematically shows a configuration of a third modification example of an outboard motor according to a preferred embodiment of the present invention.

Moreover, as shown in FIG. 8, even in a case that the upper half of the oil filter 22 is not located above the separating line 25 and the oil feeding port 23*a* and the lid 23*b* of the oil filler 23 are located below the separating line 25, the grip 24 of the oil level gauge may be located above the separating line 25. As a result, since the user is able to easily access the grip 24 of the oil level gauge, it is possible to at least improve the workability of confirming the amount of the oil.

That is, at least one of the upper end of the oil filter 22, the oil feeding port 23*a* and the lid 23*b* of the oil filler 23, and the grip 24 of the oil level gauge may be located above the separating line 25.

Figure 9:
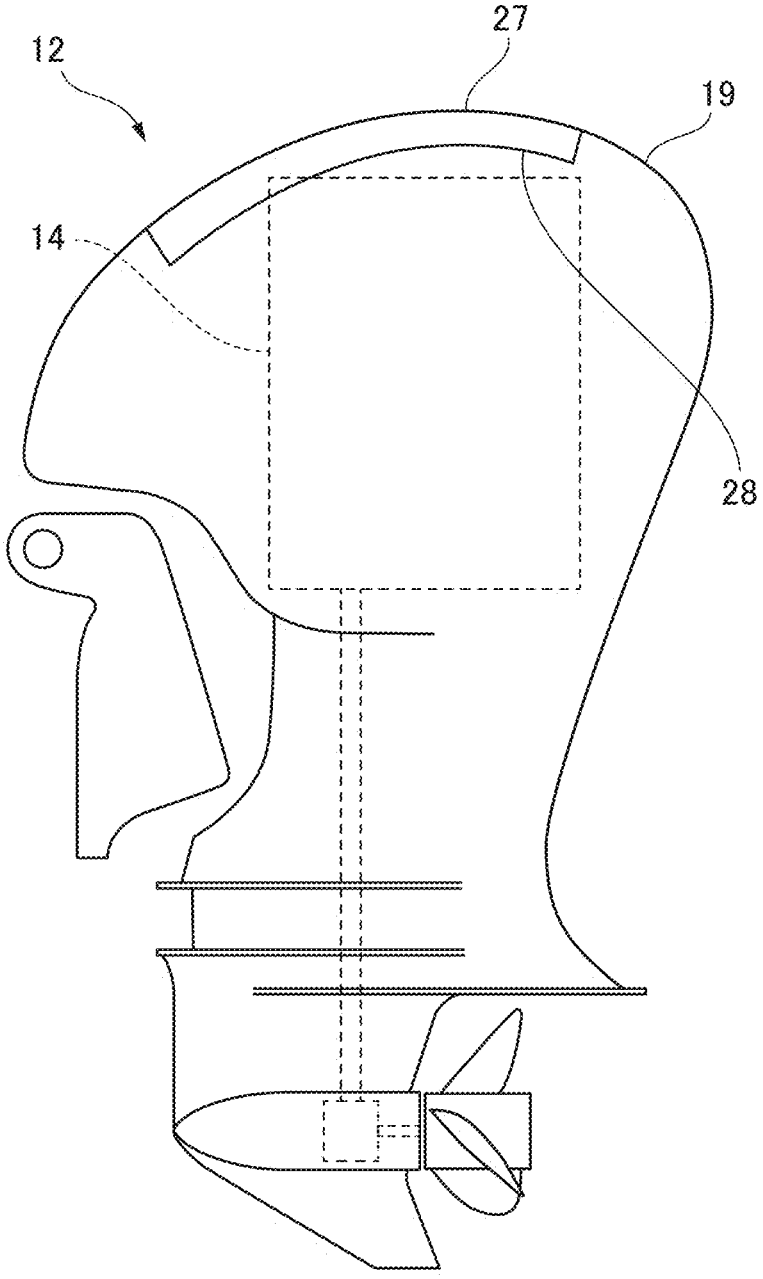
FIG. 9 is a side view that schematically shows a configuration of a fourth modification example of an outboard motor according to a preferred embodiment of the present invention.
Figure 10:
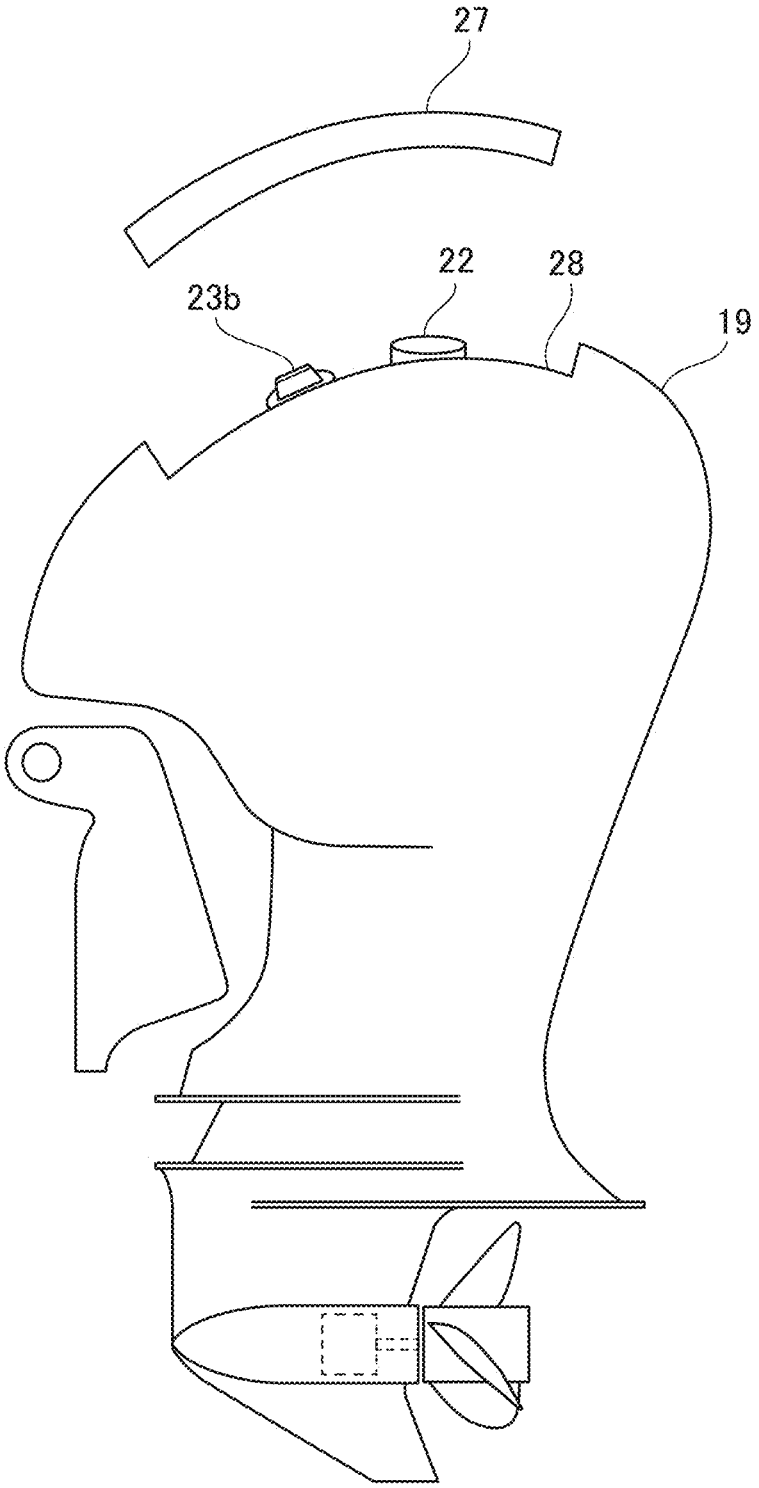
FIG. 10 is a view that shows a state in which a maintenance lid is detached from a cowl in the outboard motor of FIG. 9.

Further, in a preferred embodiment of the present invention, although the cowl 19 is separable into the top cowl 20 and the side cowl 21, as shown in FIG. 9, the cowl 19 may not be separable, and a portion of an upper portion of the cowl 19 may define a maintenance lid 27 (a lid body) which is detachable. In this case, at least one of the upper end of the oil filter 22, the oil feeding port 23*a* and the lid 23*b* of the oil filler 23, and the grip 24 of the oil level gauge may be located above a separating line 28, which is a boundary between the maintenance lid 27 and a remaining portion of the cowl 19. Moreover, FIG. 10 is a view that shows a case in which the grip 24 of the oil level gauge is located below the separating line 28 and the upper end of the oil filter 22 and the lid 23*b* of the oil filler 23 are located above the separating line 28.

As a result, when the maintenance lid 27 is detached from the cowl 19, at least one of the upper end of the oil filter 22, the oil feeding port 23*a* and the lid 23*b* of the oil filler 23, and the grip 24 of the oil level gauge is exposed to the outside of the outboard motor 12 and is easily accessible by the user. Therefore, it is possible to further improve the efficiency of the operations that accompany the oil change.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor attachable to a hull of a marine vessel, the outboard motor comprising: an internal combustion engine including an oil filler to feed oil thereto and an oil filter to filter the oil; and a cowl to cover the internal combustion engine; wherein in a case that a direction perpendicular or substantially perpendicular to a bottom of the hull is a vertical direction, the cowl is separable into a top cowl to cover an upper portion of the internal combustion engine and a side cowl to cover a side portion of the internal combustion engine; at least a portion of the oil filler or at least a portion of the oil filter is located above a separating line which is a boundary between the top cowl and the side cowl; in a case of attaching and detaching the oil filter, a rotation axis of the oil filter is tilted with respect to a crank shaft of the internal combustion engine so that an upper end of the oil filter is located farther outside the internal combustion engine than a lower end of the oil filter; and an upper half of the oil filter is located above the separating line.

2. An outboard motor attachable to a hull of a marine vessel, the outboard motor comprising: an internal combustion engine including an oil filler to feed oil thereto and an oil filter to filter the oil; and a cowl to cover the internal combustion engine; wherein in a case that a direction perpendicular or substantially perpendicular to a bottom of the hull is a vertical direction, the cowl is separable into a top cowl to cover an upper portion of the internal combustion engine and a side cowl to cover a side portion of the internal combustion engine; at least a portion of the oil filler or at least a portion of the oil filter is located above a separating line which is a boundary between the top cowl and the side cowl; in a case of attaching and detaching the oil filter, a rotation axis of the oil filter is tilted with respect to a crank shaft of the internal combustion engine so that an upper end of the oil filter is located farther outside the internal combustion engine than a lower end of the oil filter; a lid of an oil feeding port of the oil filler is located above the separating line; and the internal combustion engine includes an oil level gauge, and a grip of the oil level gauge is located above the separating line.

3. The outboard motor according to claim 1, wherein the entire oil filter is located above the separating line.

4. The outboard motor according to claim 1, wherein an upper end of the oil filter is located below an upper end of the internal combustion engine.

5. The outboard motor according to claim 1, wherein a lid of an oil feeding port of the oil filler is located above the separating line.

6. The outboard motor according to claim 1, wherein the oil filler and the oil filter are adjacent to each other.

7. The outboard motor according to claim 1, wherein the internal combustion engine includes an oil level gauge, and a grip of the oil level gauge is located above the separating line.

8. The outboard motor according to claim 1, wherein the vertical direction is a direction perpendicular or substantially perpendicular to flat land when the marine vessel is on land.

9. The outboard motor according to claim 1, wherein the vertical direction is a direction perpendicular or substantially perpendicular to a water surface when the marine vessel is stopped and floating on the water surface.

10. An outboard motor attachable to a hull of a marine vessel, the outboard motor comprising: an internal combustion engine including an oil filler to feed oil thereto and an oil filter to filter the oil; and a cowl to cover the internal combustion engine; wherein a portion of the cowl defines a lid body that is detachable from the cowl; in a case that a direction perpendicular or substantially perpendicular to a bottom of the hull is a vertical direction, at least a portion of the oil filler or at least a portion of the oil filter is located above a separating line which is a boundary between the lid body and a remaining portion of the cowl; in a case of attaching and detaching the oil filter, a rotation axis of the oil filter is tilted with respect to a crank shaft of the internal combustion engine so that an upper end of the oil filter is located farther outside the internal combustion engine than a lower end of the oil filter; and an upper half of the oil filter is located above the separating line.

11. The outboard motor according to claim 10, wherein, when the lid body is detached from the cowl, at least the portion of the oil filler or at least the portion of the oil filter, which is located above the separating line, is exposed to outside the internal combustion engine.

12. A marine vessel comprising:

the outboard motor according to claim 1.

13. A marine vessel comprising:

the outboard motor according to claim 10.

14. The outboard motor according to claim 2, wherein an upper half of the oil filter is located above the separating line.

15. An outboard motor attachable to a hull of a marine vessel, the outboard motor comprising: an internal combustion engine including an oil filler to feed oil thereto and an oil filter to filter the oil; and a cowl to cover the internal combustion engine; wherein a portion of the cowl defines a lid body that is detachable from the cowl;

in a case that a direction perpendicular or substantially perpendicular to a bottom of the hull is a vertical direction, at least a portion of the oil filler or at least a portion of the oil filter is located above a separating line which is a boundary between the lid body and a remaining portion of the cowl; in a case of attaching and detaching the oil filter, a rotation axis of the oil filter is tilted with respect to a crank shaft of the internal combustion engine so that an upper end of the oil filter is located farther outside the internal combustion engine than a lower end of the oil filter; a lid of an oil feeding port of the oil filler is located above the separating line; and the internal combustion engine includes an oil level gauge, and a grip of the oil level gauge is located above the separating line.

* * * * *